US005809860A

United States Patent [19]

Haaser

[11] Patent Number: 5,809,860

[45] Date of Patent: Sep. 22, 1998

[54] METHODS FOR FORMING LINES OF WEAKENING IN CLOSURES

[75] Inventor: James Dudley Haaser, Lancaster, Ohio

[73] Assignee: Crown Cork & Seal Technologies Corporation, Alsip, Ill.

[21] Appl. No.: 817,200

[22] PCT Filed: Oct. 12, 1995

[86] PCT No.: PCT/GB95/02388

§ 371 Date: Apr. 11, 1997

§ 102(e) Date: Apr. 11, 1997

[87] PCT Pub. No.: WO96/11856

PCT Pub. Date: Apr. 25, 1996

[30] Foreign Application Priority Data

Oct. 12, 1994 [GB] United Kingdom ..... 9420859

[51] Int. Cl.[6] ..... B26D 3/08; B31B 1/25

[52] U.S. Cl. ..... 83/880; 83/879; 215/252; 264/154; 264/163; 425/291

[58] Field of Search ..... 264/154, 163, 264/268, 156; 425/291, 809; 83/879, 880, 946; 215/252, 318

[56] References Cited

U.S. PATENT DOCUMENTS

| | | | |
|---|---|---|---|
| 4,343,754 | 8/1982 | Wilde et al. | 425/291 X |
| 4,478,343 | 10/1984 | Ostrowsky | 215/252 |
| 4,497,765 | 2/1985 | Wilde et al. | 425/291 X |
| 4,530,437 | 7/1985 | Gray et al. | 215/252 |
| 4,595,547 | 6/1986 | Herr | 264/163 X |
| 4,694,969 | 9/1987 | Granat | 215/252 |
| 4,904,435 | 2/1990 | Babcock et al. | 425/809 X |
| 5,076,453 | 12/1991 | Odet | 215/252 |
| 5,103,991 | 4/1992 | Collns | 215/252 X |
| 5,145,078 | 9/1992 | Hannon et al. | 215/252 |
| 5,190,177 | 3/1993 | Collns | 215/252 |
| 5,255,805 | 10/1993 | Weiss et al. | 215/252 X |
| 5,433,331 | 7/1995 | Morini | 215/252 X |
| 5,465,858 | 11/1995 | Gargione | 215/252 |
| 5,488,888 | 2/1996 | Kowal | 83/880 |
| 5,557,999 | 9/1996 | Smith et al. | 83/880 |
| 5,564,319 | 10/1996 | Kowal | 83/946 X |
| 5,582,308 | 12/1996 | Kishi et al. | 215/252 |
| 5,636,958 | 6/1997 | Foldesi et al. | 83/879 X |
| 5,651,299 | 7/1997 | Boyle et al. | 93/880 |

FOREIGN PATENT DOCUMENTS

| | | |
|---|---|---|
| 086 970 | 8/1983 | European Pat. Off. . |
| 117 104 | 8/1984 | European Pat. Off. . |
| 533 633 A2 | 3/1993 | European Pat. Off. . |
| 2 528 393 | 12/1983 | France . |

*Primary Examiner*—Allan N. Shoap
*Assistant Examiner*—Robin Hylton
*Attorney, Agent, or Firm*—Woodcock Washburn Kurtz Mackiewicz & Norris LLP

[57] ABSTRACT

A line of weakening (24) formed of spaced bridges (44) separated by slits (42) is formed in the skirt of a tamper-evident closure after the closure has been moulded. The line of weakening (24) is formed by a cutting operation using a knife blade (32) along the edge of which the closure is rolled without slipping. During the operation the snap-engagement band (20) of the closure is held in contact with the interior face of the skirt in transverse alignment with the knife blade (34) and the location of the line of weakening (24).

8 Claims, 3 Drawing Sheets

METHODS FOR FORMING LINES OF WEAKENING IN CLOSURES

This invention relates to closures for packaging containers, in particular, but not exclusively, to tamper-evident closures for such containers.

It is well known to provide a closure with a tamper-evident capability by forming the tubular skirt of the closure with a line of weakening so as to define a free marginal edge portion of the skirt as a security ring or band. In some closures the security ring has a snap-engagement formation, which enables it to make locking engagement with a complementary formation of the container, so that when the closure is removed it partially or wholly severs along the line of weakening, leaving the security ring either left behind on the container or attached to the closure but capable of clearly indicating that the closure has been operated. The snap-engagement formation may be a continuous annulus, or it may be formed of independantly movable, peripherally arranged, tabs.

When formed in plastics material the line of weakening may be provided by a simple peripheral groove leaving a residual thickness of plastics material which is capable of tearing when the closure is first opened. More usually, however, the line of weakening has the form of several (e.g. ten) frangible bridges of small cross-sectional area which are spaced around the closure and separated by slits at which the plastics material of the skirt is severed completely through its thickness.

Two alternative routes are commonly used for the formation of the line of weakening in a plastics skirt. In one route the line of weakening is a moulded feature of the skirt, being formed when the skirt itself is moulded. However, the moulding of the line of weakening often requires complicated and delicate tool parts which are expensive and liable to wear; moreover, the restriction to polymer flow presented by the residual plastics material (e.g the bridges) can create polymer starvation within the part of the closure which lies downstream of it in the direction of polymer flow.

The second possible route for forming the line of weakening avoids the particular shortcomings of the first route which are recited in the previous paragraph. In this further route the line of weakening is formed after the closure has been moulded, usually by means of a part-circular knife (or succession of part-circular knives) to which the closure is presented. If the line of weakening is of the kind having spaced bridges and slits separating the bridges, the knife is required to penetrate right through the wall of the closure skirt to form the slits, and hitherto it has been the practice to support the skirt internally by a roller or other support member which is inserted into it.

The support member may be made of a material, e.g rubber, with which the knife can come into contact without being blunted, or alternatively it may be arranged to cooperate with the knife by scissor action; however, in each case the contact with the knife causes degradation and wear, and the support member and/or the knife may need relatively frequent replacement or adjustment. Moreover, in those security rings having a snap-engagement formation in the form of a continuous flexible ring or a series of individual, flexibly mounted, elements which is (are) attached around the bottom free edge of the security ring and from there extend(s) upwardly and inwardly in a resilient manner for engagement with the container, the support member has hitherto being located at a sufficient height above the bottom edge of the closure skirt to ensure that it can reliably avoid contact with, and possible damage to, the snap-engagement formation as it (the support member) is being inserted into or removed from the closure or during its operation to support the closure skirt. This in turn has imposed a lower limit on the length of the skirt below the line of weakening, it being necessary to locate the line of weakening at a distance above the skirt free edge which is somewhat greater than the height of the snap-engagement formation within the closure. The skirt has accordingly been made to extend for a substantial distance below the line of weakening, often resulting in increased material cost not only for the closure itself but also for the container for which the closure is designed. The position of the free edge of the snap-engagement formation within the skirt is also subject to limitation, since it has to be located below the line of weakening.

An object of the present invention is to avoid the shortcomings of tamper-evident closures recited in the previous paragraph, and according to one aspect thereof the invention broadly provides a method of forming a line of weakening comprising alternate frangible bridges and slits in a tubular plastics skirt which extends to a bottom portion including the free bottom edge of a closure for a container, the skirt having a generally annular formation attached around the bottom portion and from there extending upwardly and inwardly of the closure for engagement with the container, characterised in that the line of weakening is formed at a location which is in transverse alignment with the said formation, at a time when the said formation is located against the interior surface of the skirt.

From another aspect the invention provides a closure for a container, which has a line of weakening comprising alternate frangible bridges and slits formed in a tubular plastics skirt which extends to a bottom portion including the free bottom edge of the closure, the skirt having a generally annular formation attached around the bottom portion and from there extending upwardly and inwardly of the closure for engagement with the container, characterised in that the line of weakening is located in transverse alignment with the said formation.

Advantageously, the line of weakening is formed by a post-forming operation performed on the exterior of the skirt when the skirt is supported internally by the formation. The post-forming operation is preferably performed by a knife, or by a series of two or more knives serially presented.

In the application of the invention to tamper-evident closures as described above, the formation will usually be a snap-engagement formation which is attached to the closure skirt around the free bottom edge of the closure, and is adapted to engage beneath a shoulder of the container at its own free edge.

Embodiments of the invention will now be described with reference to the accompanying drawings, in which.

Figure 1:
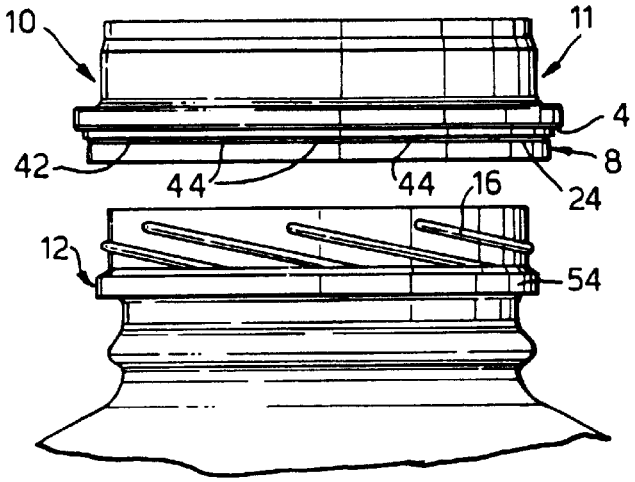
FIG. 1 shows a closure of the kind with which the invention may be used, in relation to a container to which the closure may be fitted.
Figure 2:
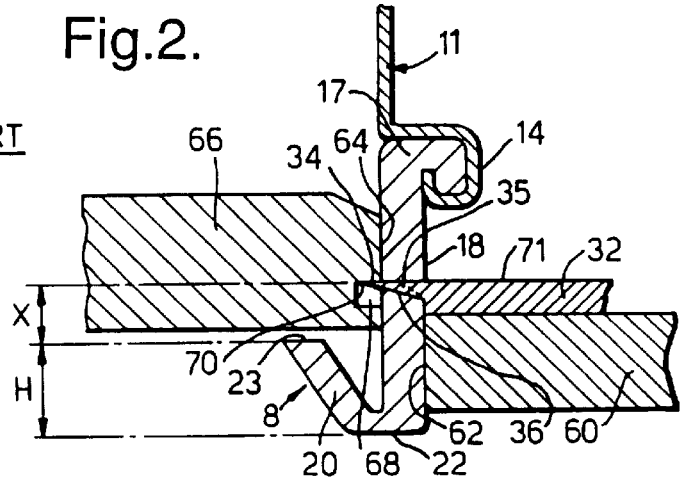
Fig.2. PRIOR ART
FIG. 2 shows a known method for forming the line of weakening in the closure of FIG. 1.

Referring now to FIG. 1 in conjunction with FIG. 2, there is shown a plastics ring member 8 which forms the free terminal edge of the tubular skirt 11 of a PT (press-on, twist-off) vacuum cap 10 for a container 12 of a food product. The closure is generally of metal; it has a metal body pressed from metal sheet, and screw threads (not shown) formed within its skirt portion for engagement with complementary screw threads 16 on the container. The metal free edge of the closure is formed as an inturned curl 14 by which the plastics ring member is firmly held at a hook portion 17 (FIG. 2) extending around its top edge. In addition to the hook portion the ring member has a cylindrical central portion 18 substantially aligned with the skirt portion (not referenced) of the metal body, and a snap-engagement formation in the form of an inturned frusto-conical ring 20 which is attached around a hinge line 22 to the bottom of the central portion (and accordingly of the closure as a whole) and from there extends upwardly and inwardly to a free inner edge 23. The snap-engagement ring 20 may be either continuous or it may be formed of individually movable segments. Its attachment to the central portion at the hinge 22 enables it readily to flex for its application to a container (not shown).

The snap-engagement ring 20 flexes outwardly from the moulded position shown when the closure is being forced onto the container during capping, and thereafter snaps resiliently back to its moulded position where it can engage beneath a complementary bead 54 (FIG. 1) on the container. The ring member 8 is then capable of providing its required tamper-evident function for the closure, and for that purpose has a line of weakening 24 formed around its central portion 18 as a peripheral groove which is spanned by a number of spaced and frangible integral bridges 44. The bridges are spaced apart by slits or openings 42 at which the central portion is completely severed through its thickness.

As is well known for closures of the kind shown, if any attempt is made to unscrew the closure for removal from the container 12, the resulting axial movement of the closure will cause the snap-engagement ring to come into engagement with the container bead 54. Further unscrewing movement then causes the bridges 44 to break, thereby leaving the portion of the ring member 8 below the bridges remaining on the container while the closure is removed. It is then difficult or impossible for a tamperer to reclose the container and reinstate the ring member 8, in particular its bridges 44, in such a way as to avoid detection.

A particular feature of the closure of FIG. 2 is that the line of weakening 23 is located above the transverse plane of the closure which includes the free inner edge 23 of the snap-engagement ring. This feature is inherent in the methods which have hitherto been used for forming the line of weakening by a cutting operation performed after moulding. For the purposes of this description the axial distance by which the line of weakening is spaced from the free edge 23 is denoted 'X' in FIG. 2.

Referring now to FIG. 2, in a known method of forming the line of weakening 24 the bridges 44 and slits 42 are created by a stationary knife 32 in the form of a notched blade of thin metal against which the closure is rotated without slipping. The knife is generally part-circular, having its peripheral cutting edge 34 recessed at spaced notches 36 by which the bridges 44 are formed. The teeth formed between the notches are denoted by the reference numeral 35.

The knife is held and supported by a carrier member 60 the cylindrical periphery 62 of which provides a limit stop to penetration of the knife into the ring member 8. Internally the ring member 8 is supported by engagement of the cylindrical periphery 64 of a grooved support roller 66 with the inside surface of the central portion 18 above and below a peripheral groove 68 which is formed in the roller. The groove is rectangular in shape, and has a downwardly facing upper face 70.

During the cutting operation the ring 8 is pinched between the carrier member 60 on its outside, and the support roller 66 on its inside. The closure 10 as a whole is therefore restrained against lateral movement, and moreover the upper face 71 of the knife is caused to cooperate with the upper face 70 of the groove 68 to form the line of weakening by scissor action.

It will be understood from the foregoing that the method used for forming the line of weakening requires the support roller 66 to be transversely aligned with the knife 32, that is to say, it must overlap with the knife axially of the closure. The roller, however, must be located above the snap-engagement ring 20 by a sufficient spacing to ensure that the roller cannot engage with, and possibly damage, the snap-engagement ring when it is being moved into and from the operative position shown and during operation to form the line of weakening. The safety margin and the overlapping of the knife with the roller together form the distance X by which the line of weakening is located axially above the free edge 23 of the snap-engagement ring.

Figure 3:
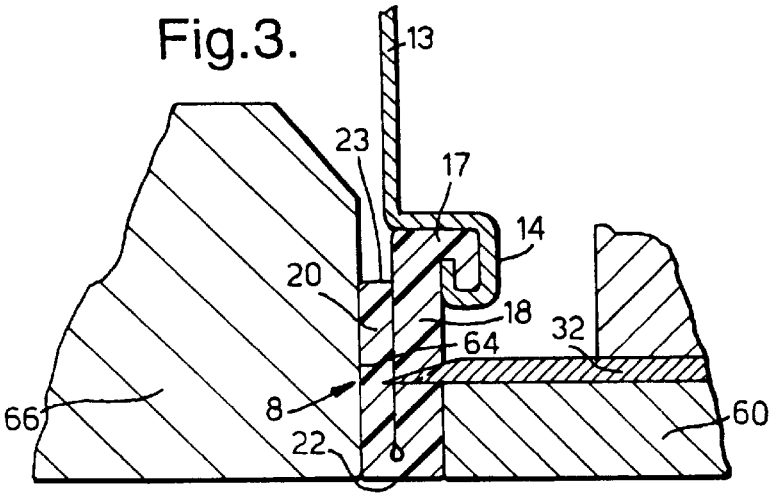
FIG. 3 shows the formation of the line of weakening by a first method in accordance with the present invention.

For many containers, however, this location of the line of weakening axially above the free edge of the snap-engagement ring requires an undesirable and costly lengthening of the container neck to accommodate the additional height involved. From another viewpoint, it imposes a limitation on the height "H" of the snap-engagement ring which can be used with the same container neck finish. FIG. 3 shows how the method of forming the line of weakening may be modified to counter this difficulty in accordance with the present invention. In FIG. 3 the same reference numerals as before are used to indicate the same or equivalent features. The closure 10 is still as it appears in FIG. 1, although with dimensional changes made to the ring member 8.

Figure 4:
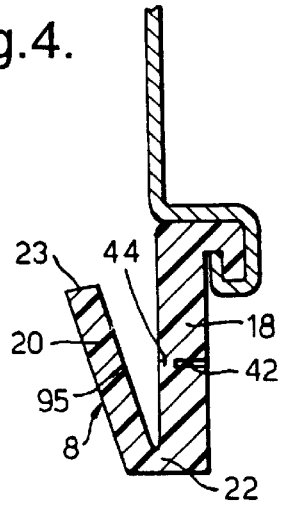
FIG. 4 shows the closure after formation of the line of weakening in accordance with FIG. 3.

Referring now to FIG. 3, instead of directly engaging the inside face of the central portion 18 of the ring member 8, in accordance with the teachings of the invention the support roller 66 now supports the central portion 18 indirectly, acting through the snap-engagement ring 20 which is folded outwardly about the hinge line 22 so as to be in face-to-face contact with the central portion. The knife 32 is again transversely aligned with the support roller. During the formation of the line of weakening 24 in the central portion the knife may, as shown, and indicated in FIG. 4 by the partial cut 95 cut into the outer surface of the snap-engagement ring, but the depth of penetration is small and not sufficient to destroy the ability of the snap-engagement ring to perform its required function to break the bridges when the closure is opened.

From the foregoing paragraph it will be seen that in relation to the closure the line of weakening 24 is aligned transversely with the snap-engagement ring 20; to put it another way, from its attachment at the hinge line 22 the snap-engagement ring extends, axially of the closure, beyond the line of weakening to its own terminal free edge 23. Several advantages accrue from this arrangement over that described in relation to FIG. 2; namely (1) the support roller no longer has a groove 68, but instead has a simple cylindrical periphery which is available to provide support for the central portion in direct alignment with the knife; (2) the vertical position of the knife in relation to the support roller 66 is no longer critical, because no scissor action is involved; (3) the vertical position of the knife in relation to the ring member can be adjusted within wide limits since it no longer has to lie above the free edge 23 of the snap-engagement ring; and (3) for the same reason the vertical length of the snap-engagement ring can be varied within wide limits to suit the finish of the container to which the closure is to be fitted.

Figure 5:
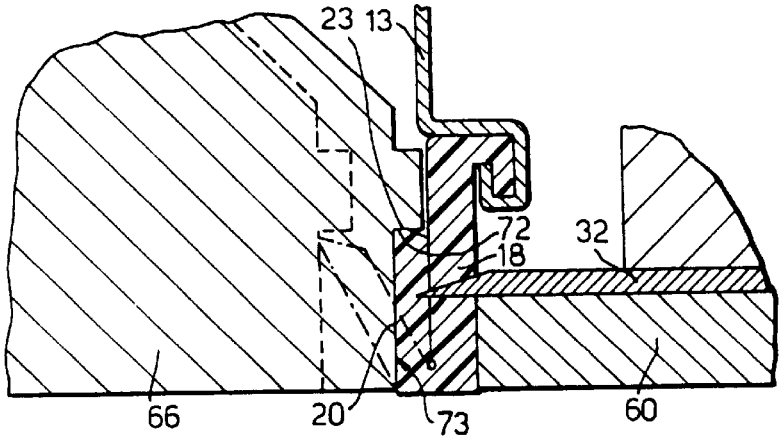
FIG. 5 is a view corresponding to FIG. 3 and illustrating a second method in accordance with the invention.

FIG. 5 illustrates a second method of performing the cutting operation on the closure 10, in which the support roller 66 engages the free top edge 23 of the snap-engagement ring 20 while cutting is taking place. The engagement occurs at a horizontal, downwardly facing shoulder 72 of a peripheral notch 73 of the support roller, in which the snap-engagement ring is accommodated. It will be understood that by virtue of this engagement the support roller restrains the closure against vertical movement in the locality of cutting. The significance of this will become apparent later.

In the embodiments described above with reference to FIGS. 3 to 5 the manner in which the closure 10, the carrier member 60 with knife 32, and the support roller 66 are brought into operative engagement with one another forms no part of the present invention and is therefore only described briefly below. In one preferred arrangement the carrier member and the knife are located on the periphery of a substantially circular and stationary central turret, and the support roller is part of a planetary roller assembly which is one of several identical assemblies which are constrained and driven to move around a fixed circular path concentric with the turret. Intermeshing gears of the turret and each roller assembly drive the support rollers 66 to rotate at a predetermined speed about their axes so that only rolling contact occurs between the carrier member 60 and the ring member 8 as the closure passes the knife.

A machine generally arranged as described in the previous paragraph and capable of ready adaptation for operation in accordance with the present invention is particularly described with reference to the drawings (FIGS. 1 to 4) of European patent publication No. EP.0533633 (Italcaps S.p.A - Agents reference 4499). That disclosure is hereby imported into this specification by reference, but its FIGS. 2 and 3 are reproduced as FIGS. 6 and 7 of this application when suitably modified to incorporate the embodiment of FIGS. 3 and 4 of this application.

Figure 6:
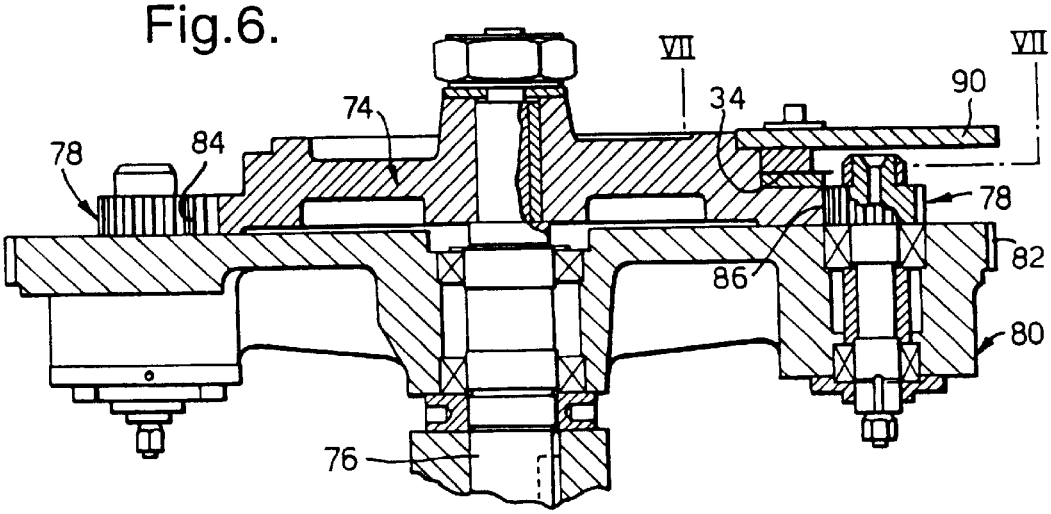
FIG. 6 is a view in central vertical section of a first apparatus capable of performing the present invention.
Figure 7:
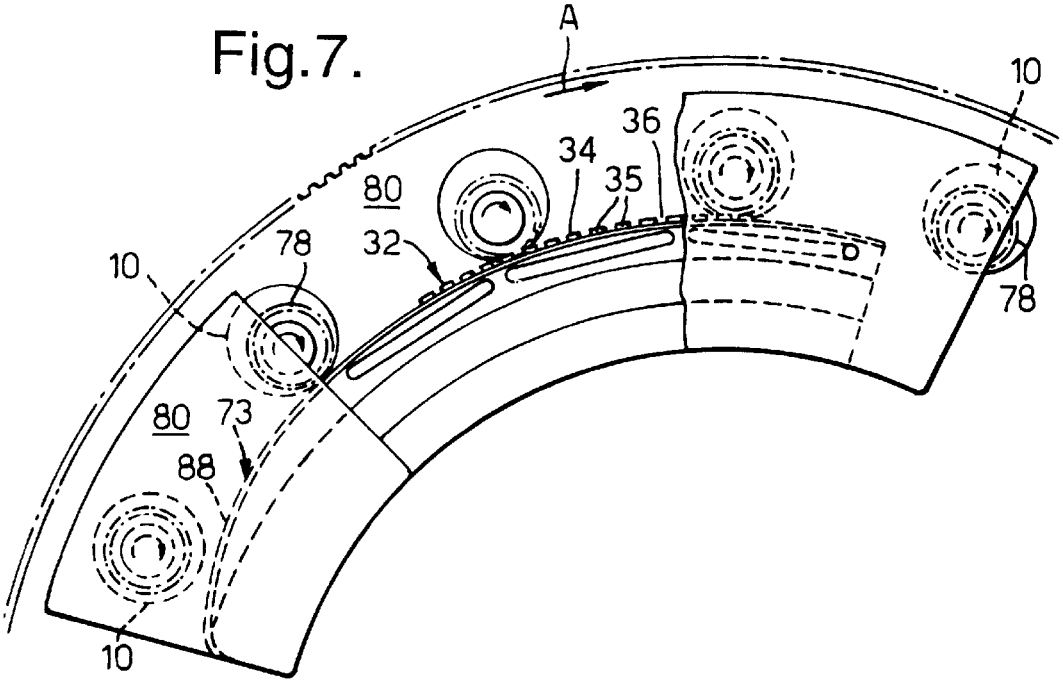
FIG. 7 is a view of part of the apparatus of FIG. 6 when seen from above on the section VII—VII of FIG. 6.

Referring now to FIGS. 6 and 7, the non-rotary central turret, now referenced 74, is located on a central, non-rotary shaft 76. Two of the planetary roller assemblies are shown in FIG. 6 and denoted 78. They are carried on the periphery of a wheel 80 which is mounted for free rotation on the shaft 76 beneath the turret. Gear teeth 82 on its periphery are capable of meshing with a driven gear (not shown) to rotate the wheel with a predetermined speed and direction.

As the wheel 80 rotates each planetary roller assembly 78 is individually driven to rotate by meshing gears 84, 86 on the turret 74 and the roller assembly. The position of gear engagement is vertically aligned with the cutting location, so ensuring that no slippage occurs which could impair the quality of the line of weakening created on the closure.

FIG. 7 shows five of the roller assemblies 78 on a segment of the wheel 80 within which the cutting operation takes place. The wheel is to be understood as moving in a clockwise direction in a circular path generally from left to right, as indicated by the arrow A. The roller assemblies accordingly rotate at the same peripheral speed in a clockwise direction.

In FIG. 7 the cutting edge 34 of the knife 32 is visible, with its teeth 35 and notches 36 for respectively forming the slits 42 and bridges 44 of lines of weakening on closures 10 which are carried past it.

Upstream of the knife in the direction of motion of the wheel 80, the turret 74 has a cam face 88 by which the closures individually placed on the roller assemblies and carried along by them are progressively moved outwardly and into the required offset position on their respective roller assemblies for engagement by the knife edge 32. As indicated in FIGS. 3 and 5, their ring members 8 are then pinched and located in the lateral sense between the turret on the outside of the closure, and the support roller 66 within the closure. Vertical restraint for the closure during this time is provided by an overlying flange 90 (FIG. 6) carried from the turret.

In a modification of the apparatus of which part is shown in FIG. 5, the flange 90 is omitted. Vertical restraint for a closure 10 during cutting is provided wholly by the downwardly facing shoulder 70 previously mentioned.

FIG. 5 shows, in ghosted outline, the position of the support roller 66 and snap-engagement band 20 while the support roller and the closure 10 are moving relatively to one another prior to cutting, as previously described. Further relative approaching movement of the support roller towards the central portion 18 of the closure from that position will create some axial compression in the band 20. Applicants have found this to be helpful for achieving accurate and reliable cutting.

Figure 8:
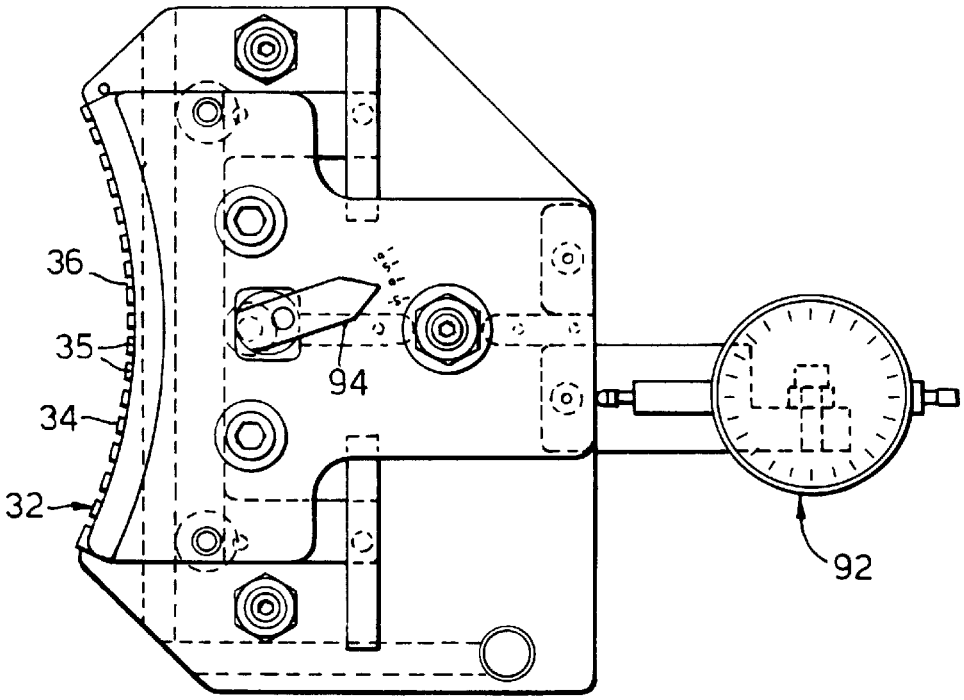
FIG. 8 shows a knife holder forming part of a second apparatus capable of performing the present invention, as seen from above.

The knife 32 of the apparatus shown in FIGS. 6 and 7 is mounted within the circular locus of the roller assemblies 78, and accordingly its cutting edge 34 is generally convex. This relatively inaccessible position makes it difficult to adjust the radial position of the knife during operation of the machine, should this be needed. FIG. 8 shows the holder 90 of the knife 32 of a modified machine. The knife again has a cutting edge 34 with teeth 35 and notches 36, but it is concave rather than convex as before. The fixed structure of the machine, corresponding to the turret 74 in FIGS. 6 and 7, is extended radially outwardly beyond the roller assemblies 78 for carrying the knife in a position for engaging the closures radially outside the roller assembly path, rather than within that path as before. An associated cam face (not shown) corresponding to the cam face 88 but of concave rather than convex shape, produces any required inward movement of the closures to their offset positions on the roller assemblies for cutting. A micrometer gauge 92 enables the position of the knife to be adjusted radially "on the run". A lever 94 is available to adjust the attitude of the knife in the horizontal plane.

For closures of which the snap-engagement ring is discontinuous, it is preferred that the interruptions in the ring should have a small peripheral length so that the backing support provided by the snap-engagement ring for the cutting operation is still substantially uniform around the closure.

The invention is not limited in application to tamperevident PT-caps as particularly described, but may have wide application to closures at least part of the tubular skirt of which is of plastics material. The invention thus has application to closures which are substantially or wholly of plastics material. Also, although primarily conceived for forming lines of weakening which define the security bands of tamperevident closures and which accordingly are visible from outside the closure, the invention may be used for forming lines of weakening for other purposes, providing that a container-engageable formation is available within the closure in transverse alignment with the location of the line of weakening.

I claim:

1. A method of forming a line of weakening in a closure for a container, said closure comprising a tubular plastics skirt portion, said skirt portion having a hingedly connected formation extending upwardly and inwardly for engagement with a complementary formation of said container to which said closure is fitted, said line of weakening comprising alternate frangible bridges and slits in said skirt portion of said closure, said method comprising the step of:

(a) cutting into said skirt portion while said hinged formation abuts the interior surface of said skirt portion, at a location on the closure exterior which is radially aligned with said hinged formation, thereby forming said bridges and slits; such that said slits extend through said skirt portion and partially into said hinged formation.

2. A method in accordance with claim 1, wherein said bridges and slits are formed by cutting means engaged with the skirt portion exteriorly of the closure while said closure is restrained against lateral movement away from said cutting means by engagement with an interior surface of said hinged formation.

3. A method in accordance with claim 2, wherein the interior surface of said hinged formation is engaged by support means having a shoulder by which said closure is restrained against axial movement by engagement with a free edge of said hinged formation.

4. A method in accordance with claim 2, wherein said cutting means is a knife.

5. A method in accordance with claim 3, wherein said support means is a roller.

6. A method in accordance with claim 1, wherein said hinged formation is a snap engagement ring.

7. A method in accordance with claim 1, wherein said hinged formation extends axially of the closure and beyond the line of weakening.

8. A method in accordance with claim 2, wherein said closure is restrained against lateral movement away from said cutting means by engagement with support means that engage the interior surface of said hinged formation.

* * * * *

UNITED STATES PATENT AND TRADEMARK OFFICE

CERTIFICATE OF CORRECTION

PATENT NO. : 5,809,860
DATED : September 22, 1998
INVENTOR(S) : James Dudley Haaser It is certified that error appears in the above-indentified patent and that said Letters Patent is hereby corrected as shown below:

Title page item [30] Line 16, delete "9420859" and insert - - 94208959.2- - therefor.

Under item [56] Line 5, delete "Collns" and insert - - Collins- - therefor.

under item [56] Line 7, delete "Collns" and insert - - Collins- - therefor.

under item [57] Lines 28-29, delete "temper-evident" and insert - -tamper-evident- - therefor.

Column 1, Line 19, delete "independantly" and insert - -independently- - therefor.

Signed and Sealed this

First Day of June, 1999

*Attest:*

Q. TODD DICKINSON

*Attesting Officer*

*Acting Commissioner of Patents and Trademarks*